US010746189B2

(12) United States Patent
Ruzicka et al.

(10) Patent No.: US 10,746,189 B2
(45) Date of Patent: Aug. 18, 2020

(54) CENTER BUSHING TO BALANCE AXIAL FORCES IN MULTI-STAGE PUMPS

(71) Applicant: FLUID HANDLING LLC., Morton Grove, IL (US)

(72) Inventors: Paul J. Ruzicka, Auburn, NY (US); Christopher J. Felix, Farmington, NY (US); Marcos D. Roimicher, Lombard, IL (US)

(73) Assignee: Fluid Handling LLC, Morton Grove, IL (US)

( * ) Notice: Subject to any disclaimer, the term of this patent is extended or adjusted under 35 U.S.C. 154(b) by 413 days.

(21) Appl. No.: 15/452,068

(22) Filed: Mar. 7, 2017

(65) Prior Publication Data

US 2017/0298948 A1 Oct. 19, 2017

Related U.S. Application Data

(60) Provisional application No. 62/305,305, filed on Mar. 8, 2016.

(51) Int. Cl.
*F04D 29/056* (2006.01)
*F04D 1/06* (2006.01)
(Continued)

(52) U.S. Cl.
CPC ..... *F04D 29/056* (2013.01); *F04D 1/06* (2013.01); *F04D 17/12* (2013.01); *F04D 17/164* (2013.01);
(Continued)

(58) Field of Classification Search
CPC ..... F04D 29/041; F04D 29/051; F04D 17/12; F04D 17/164; F04D 1/06; F04D 1/063; F04D 1/066; F04D 1/10; F01D 3/00
See application file for complete search history.

(56) References Cited

U.S. PATENT DOCUMENTS 2,286,522 A * 6/1942 Watson ..... F04D 17/12 415/100
2,361,521 A * 10/1944 Yates De Witt .... F04D 29/2266 415/106
(Continued)

FOREIGN PATENT DOCUMENTS

CH 655357 A5 * 4/1986 ..... F16C 32/044
CH 655357 A5 4/1986
(Continued)

OTHER PUBLICATIONS

Xylem, "AC Fire Pump" (Year: 2012).*
(Continued)

*Primary Examiner* — Michael Lebentritt
*Assistant Examiner* — Topaz L. Elliot
(74) *Attorney, Agent, or Firm* — Ware, Fressola, Maguire & Barber LLP

(57) ABSTRACT

A multi-stage pump featuring different stages configured to pump a fluid from a pump suction and to a pump discharge; and a center bushing configured between the different stages, having a center bushing side configured with pockets to balance axial forces between the different stages of the multistage pump. The pockets are configured as curved rib pockets, extruded circle or circular pockets, or full length rib pockets.

20 Claims, 4 Drawing Sheets

(51) Int. Cl.
*F04D 29/051* (2006.01)
*F04D 29/041* (2006.01)
*F04D 17/12* (2006.01)
*F04D 17/16* (2006.01)

(52) U.S. Cl.
CPC ..... *F04D 29/041* (2013.01); *F04D 29/0413* (2013.01); *F04D 29/051* (2013.01)

(56) References Cited

U.S. PATENT DOCUMENTS 2,391,811 A * 12/1945 Wilhelm ..... F04D 1/10 415/94
2,395,793 A * 2/1946 Stratford ..... F04D 29/044 415/100
2,706,452 A 4/1955 Leslie
2,750,893 A * 6/1956 Thomas ..... F04D 1/10 415/94
2,820,088 A 1/1958 Sperry
3,017,837 A 1/1962 Judd
3,149,819 A 9/1964 Baumann et al.
3,289,542 A 12/1966 Fikse
3,643,290 A 2/1972 Milne
3,764,236 A * 10/1973 Carter ..... F04D 1/06 415/104
4,101,243 A * 7/1978 Tatkov ..... F04D 1/06 415/201
4,396,358 A 8/1983 de Concini
5,232,342 A * 8/1993 Thompson ..... F04D 1/06 384/295
5,320,482 A * 6/1994 Palmer ..... F04D 29/0416 415/104
5,366,359 A 11/1994 Bookbinder et al.
5,490,760 A * 2/1996 Kotzur ..... F01D 15/12 415/115
5,765,950 A 6/1998 Eno et al.
6,061,870 A 5/2000 Dodge et al.
6,068,444 A 5/2000 Sheth
6,359,224 B1 3/2002 Beele
6,499,955 B2 * 12/2002 Choi ..... F04D 17/12 416/185
7,237,474 B2 7/2007 Schlitzkus et al.
7,273,066 B2 9/2007 Van der Blom
7,354,240 B2 * 4/2008 Choi ..... F01D 3/04 415/104
7,575,413 B2 * 8/2009 Semple ..... F04D 1/063 415/107
7,670,110 B2 * 3/2010 Erler ..... F04D 29/046 415/195
7,731,476 B2 * 6/2010 Ganelin ..... F01D 3/00 415/104
8,282,340 B2 * 10/2012 Kim ..... F01D 3/04 415/106
8,938,975 B2 * 1/2015 Behaghel ..... F01D 3/04 415/208.2
9,874,220 B2 * 1/2018 Adams ..... F04D 29/667
10,145,381 B2 * 12/2018 Miyata ..... F04D 25/163
2006/0204359 A1 9/2006 Semple et al.
2007/0140834 A1 6/2007 Choi et al.
2009/0004032 A1 * 1/2009 Kaupert ..... F01D 11/001 417/365
2009/0062020 A1 3/2009 Edwards et al.
2010/0180589 A1 7/2010 Berger et al.
2011/0072612 A1 3/2011 Boote
2011/0078875 A1 4/2011 Boote
2012/0219411 A1 8/2012 Hein et al.
2014/0186136 A1 7/2014 Holt et al.
2014/0369865 A1 12/2014 Marsal et al.
2015/0159666 A1 6/2015 McManus et al.
2015/0226219 A1 8/2015 Johnson et al.
2019/0055954 A1 * 2/2019 Egawa ..... F04D 29/057

FOREIGN PATENT DOCUMENTS

FR 2691513 A1 5/1992
GB 430949 A * 6/1935 ..... F04D 29/445
WO 2013173054 A1 11/2013
WO 2015038629 A1 3/2015
WO WO-2015094249 A1 * 6/2015 ..... F04D 13/10

OTHER PUBLICATIONS

Xylem, 8200 Series Base Mounted Centrifugal Fire Pumps (Year: 2014).*
McNally Institute "Series or Parallel Pump Operation" accessed on Oct. 27, 2019 at http://www.mcnallyinstitute.com/18-html/18-1.htm (Year: 2019).*
Maxwell, Trey, and John M. Griffith. "Multistage pump efficiency gains through the elimination of the seal chamber pressure equalization line." Texas A&M Univ., turbolab.tamu.edu, 2008. http://turbolab.tamu.edu/proc/pumpproc/P21/08.pdf.
English language Abstract of FR2691513.
English language Abstract of CH655357.

* cited by examiner

*FIG. 1*: Example of a multi-stage pump (Prior art)

FIG. 3: Radial–formed rib pockets

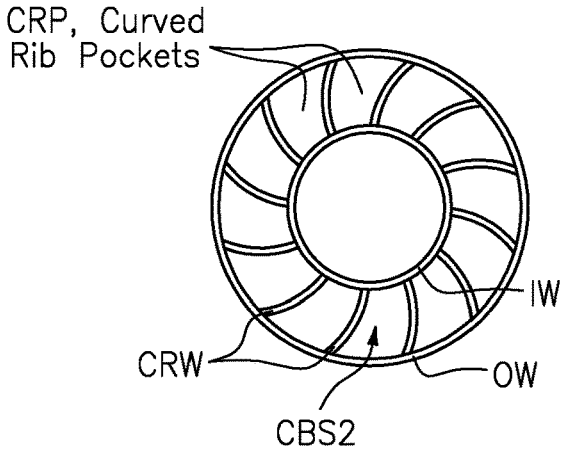
*FIG. 4A*: Center bushing CB2, having curved rib pockets
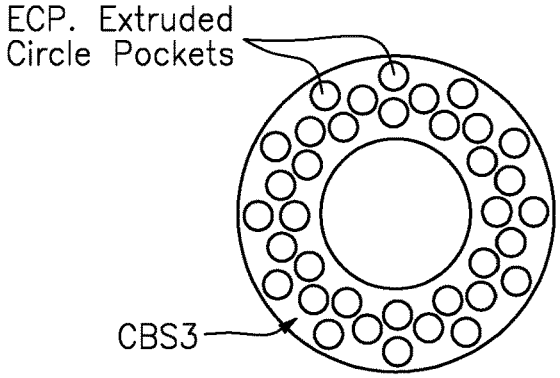
*FIG. 4B*: Center bushing CB3, having extruded circle pockets
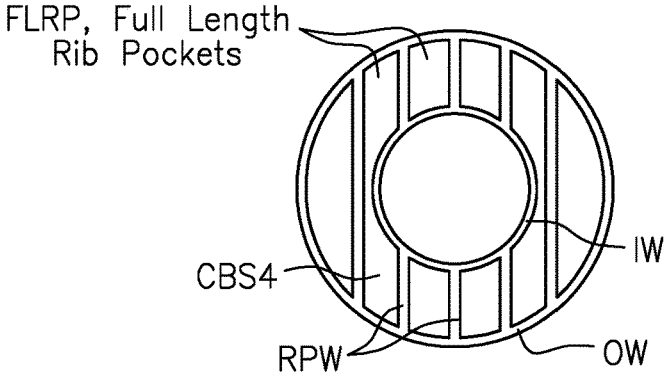
*FIG. 4C*: Center bushing CB4, having full length rib pockets

CENTER BUSHING TO BALANCE AXIAL FORCES IN MULTI-STAGE PUMPS

CROSS-REFERENCE TO RELATED APPLICATIONS

This application claims benefit to provisional application Ser. No. 62/305,305, filed 8 Mar. 2016, which is hereby incorporated by reference in its entirety.

BACKGROUND OF THE INVENTION

1. Field of the Invention

The present invention relates to a multi-stage pump; and more particularly relates to a center bushing for a multi-stage pump.

2. Brief Description of Related Art

In multi-stage pumps, e.g., like that shown in FIG. 1, a normal center bushing acts as a controlled leakage point between the different stages of the pump, as well as acts to minimize generated axial thrust. Sometimes, the center bushing acts as a divide between the different stages and only allows minimal balancing though the small leakage point between the rotating and stationary element. There are numerous axial thrust balancing methods that allow higher forces to pass through the center bushing to the lower pressure side.

To aid in balancing the axial forces, the higher pressures must be able to flow to an area of lower pressure, e.g., via balance holes, pump out vanes, or other similar thrust reducing designs which may allow this pressure to be reduced. The introduction of these passages increases the leakage between the stages which may negatively affect the efficiency. If these forces are not reduced, it may lead to increasing the size of the bearing system. A larger bearing/frame system may cost more and these larger bearings may use more power, therefore reducing the overall efficiency.

Currently, in the 8200 Series multi-stage pumps there are a total of eight (8) parts that need to be assembled to help reduce the axial forces; and the parts are as follows:

TABLE I

Parts of 8200 Series multi-stage pumps

| Item No. | Description | Qty |
|---|---|---|
| 1 | Spiral pin | 2 |
| 2 | Bushing; interstage diaphragm | 1 |
| 3 | O-ring; bushing, lower | 2 |
| 4 | Inter-stage diaphragm | 1 |
| 5 | O-ring; bushing, upper | 1 |
| 6 | Retaining ring | 1 |
| | Total | 8 |

The assembly and serviceability are rather difficult because of the complexity of the components.

In view of this, there is a need for a better way to balance the uneven axial forces generated within a multi-stage pump, e.g., in order to allow the higher pressures to flow to a location of lower pressure.

SUMMARY OF THE INVENTION

In summary, the present invention provides a new and unique center bushing that still has a small controlled leakage between the stationary and rotating elements. The present invention will increase the axial forces in the higher pressure section of the pump, by introducing pockets to the center bushing. The velocity that is on the backside of the high pressure stage is reduced, which will increase the pressure locally on the backside of the respective stage. Since the pressure in this section is now being increased, a new way of balancing is introduced. As the pressure on the high pressure side is increased due to a decreased velocity, this helps to create an axial force balance between the different stages. When the multi-stage pump designer is calculating the axial forces, the results are a force with a magnitude and a direction. The present invention will be directionally interchangeable depending on the direction of the axial force. Depending on the direction of the thrust, the present invention will allow for a placement so it can always be located on the desired side to help increase the local pressure which will help to balance the axial forces. The center bushing or device will only need to be pinned in one locating to prevent rotation, and with running tight tolerances between the center bushing or device and the pump's casing these tight clearances allow for the removal of O-ring features or devices that aid in the prevention of leakage. By making the diameter of the center bushing or device the same diameter as the wear rings, no diameter difference is introduced that may create another location for axial forces to act upon. Also by removing the extra balance holes drilled through the center bushing, which helps offset the axial forces, there is less of a leakage path. By reducing the leakage path, efficiency may be increased. By balancing axial forces, the thrust absorbing bearing system may be reduced. If the bearing system is retained without reduction, it will improve reliability. If the bearing system is reduced, both cost of the bearing and power loss within the bearing will be reduced. Reduction of power can lead to gains in efficiency.

The original and alternate center bushing configurations disclosed herein are designed to reduce velocity behind the stage of higher pressure which will proportionally increase the pressure behind the respective stage. This pressure increase may help to offset the larger axial forces generated from the pressure rise across the stage which will help to balance resultant axial forces.

Examples of Particular Embodiments

According to some embodiments, the present invention may take the form of a multi-stage pump, featuring:

- a pump having different stages configured to pump a fluid from a pump suction and to a pump discharge; and
- a center bushing configured between the different stages, having a center bushing side configured with pockets to balance axial forces between the different stages of the multistage pump.

The multi-stage pump according to the present invention may include one or more of the following features:

Radially-Formed Rib Pockets

The pockets may include, or take the form of, radially-formed rib pockets.

By way of example, the center bushing side may include a center bushing surface having an inner wall, an outer wall and a plurality of radial walls all extending from the center bushing surface, each radially-formed rib pocket having by a combination of an inner wall portion, a corresponding outer wall portion and adjacent radial walls connecting the inner wall portion and the corresponding outer wall portion.

The inner wall may include, or form part of, an inner circular wall extending around the inner edge of the center bushing.

The outer wall may include, or form part of, an outer circular wall extending around the outer edge of the center bushing.

Curved Rib Pockets

The pockets may include, or take the form of, curved rib pockets.

By way of example, the center bushing surface may include an inner wall, an outer wall and a plurality of curved rib walls all extending from the center bushing surface, each radially-formed rib pocket having by a combination of an inner wall portion, a corresponding outer wall portion and adjacent curved rib walls connecting the inner wall portion and the corresponding outer wall portion.

Extruded Circle or Circular Pockets

The pockets may include, or take the form of, extruded circle or circular pockets, e.g., which are formed as raised cylindrical protrusions having an outer cylindrical wall and a top surface.

Full Length Rib Pockets

The pockets may include, or take the form of, full length rib pockets.

By way of example, the center bushing surface may include an inner wall, an outer wall and a plurality of full length rib walls all extending from the center bushing surface, each radially-formed rib pocket having by a combination of an inner wall portion, a corresponding outer wall portion and adjacent full length rib walls connecting the inner wall portion and the corresponding outer wall portion.

Other Features

The different stages may have an area/location of higher pressure and a corresponding area/location of lower pressure; and the pockets may be configured to increase the axial forces in the area/location of higher pressure.

A center bushing side may include a high pressure side configured with the pockets facing the area/location of higher pressure.

The multi-stage pump may include a stationary element configured with an aperture; and the center bushing may include an outer circumferential rim configured with a pin to couple into the aperture of the stationary element to prevent rotation of the center bushing.

The stationary element may be configured with a circumferential surface having an inner diameter; and the outer circumferential rim may include an outer diameter that substantially corresponds in dimension to the inner diameter of the circumferential surface of the stationary element in order to substantially reduce or prevent leakage between the different stages.

The different stages may include:

- a first stage configured with an area/location of lower pressure, and
- a second stage configured with a corresponding area/location of high pressure; and
- a center bushing side having a high pressure side configured with the pockets facing the corresponding area/location of higher pressure.

According to some embodiments, the present invention may take the form of a multi-stage device featuring a device having different stages configured to provide a fluid; and a center bushing configured between the different stages, having a center bushing side configured with pockets to balance axial forces between the different stages of the multistage device. The multi-stage device may include, or take the form of, a multi-stage pump, fan, blower or compressor. The pockets may include, or be configured as, radially-formed rib pockets, or curved rib pockets, or extruded circle or circular pockets, or full length rib pockets.

Advantages of the Present Invention

By way of example, advantages of the present invention may include the following:

The new and unique center bushing helps to balance the uneven axial forces generated within the multi-stage pump, by allowing the higher pressures to flow to a location of lower pressure. Therefore, the axial thrust may be reduced and brought down to a level that can be handled by the bearing system.

BRIEF DESCRIPTION OF THE DRAWING

The drawing, which is not necessarily drawn to scale, includes the following Figures:

FIG. 4A shows a diagram of a center bushing having curved rib pockets, according to some embodiments of the present invention.

FIG. 4B shows a diagram of a center bushing having extruded circular rib pockets, according to some embodiments of the present invention.

FIG. 4C shows a diagram of a center bushing having full length rib pockets, according to some embodiments of the present invention.

Figure 1:
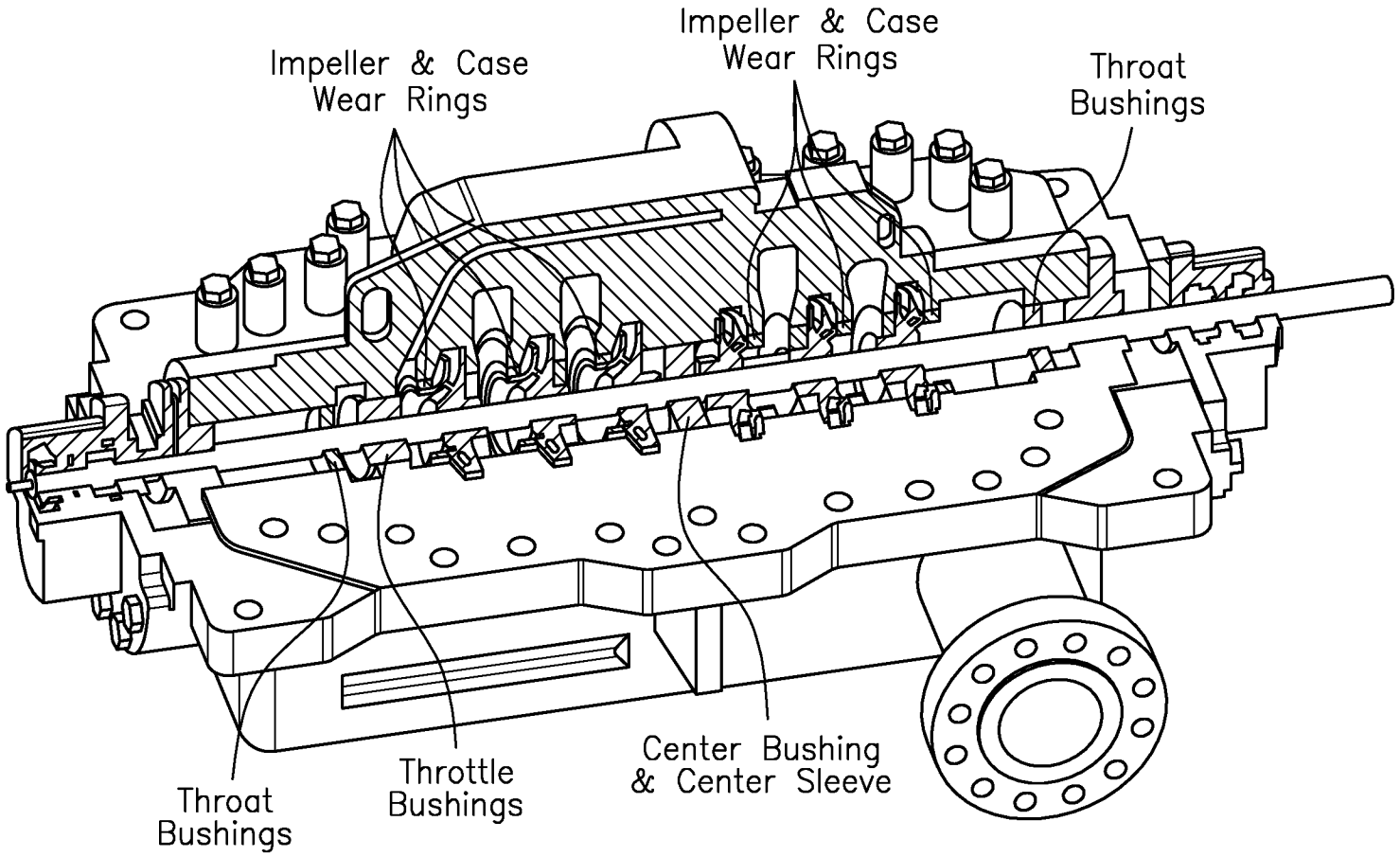
FIG. 1 shows a diagram of a multistage pump, which is known in the art.

The Figures include reference numerals and lead lines, which are included to describe each Figure in detail below. In the drawing, similar elements in the various Figures are labeled with similar reference numerals and lead lines. Moreover, not every element is shown and/or labeled with a reference numeral and lead line in every Figure to reduce clutter in the drawing as a whole.

DETAILED DESCRIPTION OF THE INVENTION

Figure 2:
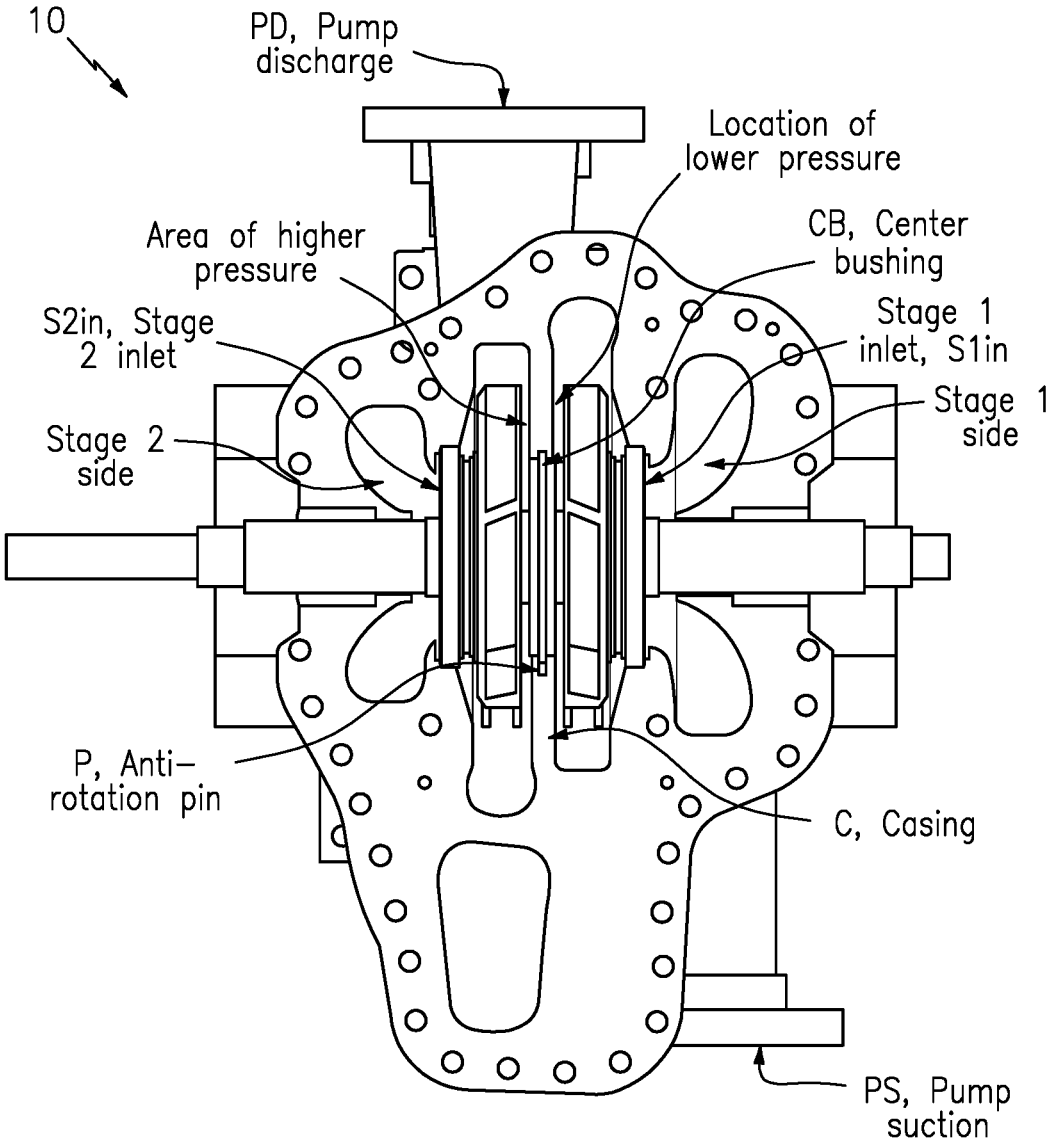
FIG. 2 shows a diagram of a multi-stage pump having a center bushing, according to some embodiments of the present invention.

FIG. 2: The Basic Invention

According to some embodiments, the present invention may take the form of a multi-stage pump generally indicated as 10, featuring:

- a pump having different stages, e.g., like stage pump 1 and stage pump 2, configured to pump a fluid from a pump suction PS and to a pump discharge PD; and a center bushing CB configured between the different stages, having a center bushing side labeled as CBS1, CBS2, CBS3, CBS4 (see FIGS. 3 and 4A, 4B, 4C) configured with pockets labeled as PKT, CRP, ECP, FLRP (see FIGS. 3 and 4A, 4B, 4C) to balance axial forces between the different stages (e.g., stage 1 and stage 2) of the multistage pump 10.

The different stages may have an area/location of higher pressure as shown and indicated in FIG. 2 and a corresponding area/location of lower pressure as shown and indicated in FIG. 2; and the pockets (see FIGS. 3 and 4A, 4B, 4C) may be configured to increase the axial forces in the area/location of higher pressure.

The center bushing side CBS1 may include a high pressure side configured with the pockets (e.g., such as PKT (FIG. 3), CRP (FIG. 4A), ECP (FIG. 4B), FLRP(FIG. 4C)) facing the area/location of higher pressure. e.g., which is towards the left for the multi-stage pump shown in FIG. 2.

The different stages may include:

a first stage (stage 1) configured with an area/location of lower pressure, and a second stage (stage 2) configured with a corresponding area/location of high pressure; and the center bushing side CBS1 that includes a high pressure side configured with the pockets (e.g., such as PKT (FIG. 3), CRP (FIG. 4A), ECP (FIG. 4B), FLRP(FIG. 4C)) facing the corresponding area/location of higher pressure.

FIG. 3: Radially-Formed Rib Pockets (PKT)

Figure 3B:
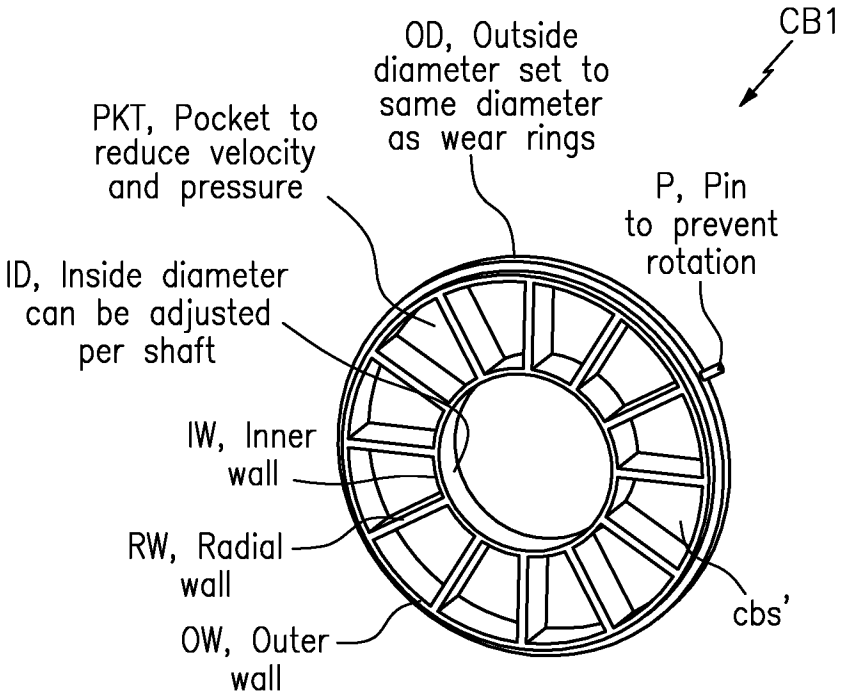
FIG. 3 includes FIGS. 3A and 3B, which shows different perspective views of a center bushing having radially-formed rib pockets, according to some embodiments of the present invention.
Figure 3A:
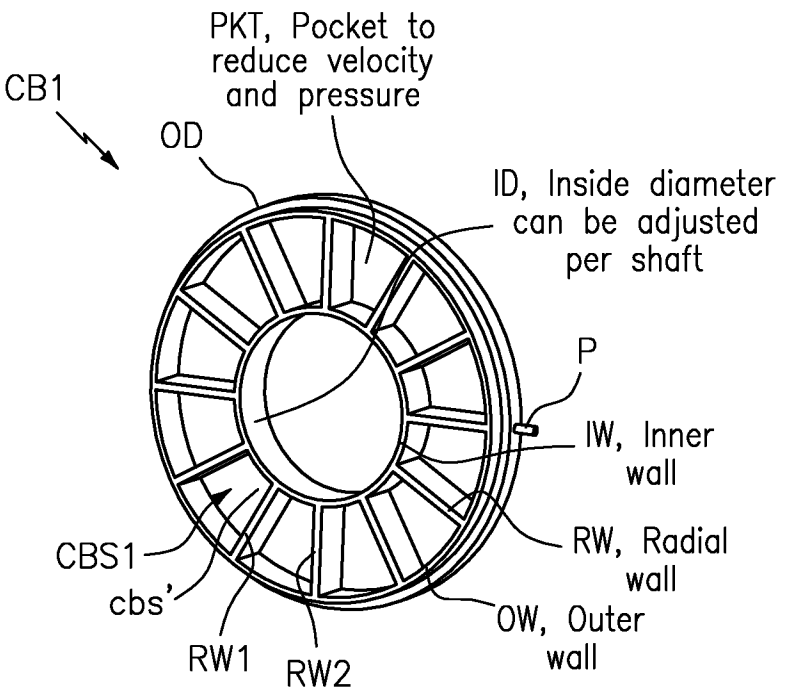

By way of example, the pockets (PKTs) may be configured as radially-formed rib pockets. FIGS. 3A, 3B show the center bushing side CBS1 of the center bushing CB1, which may include a center bushing surface cbs' having an inner wall IW, an outer wall OW and a plurality of radial walls RW, all extending outwardly from the center bushing surface cbs', as shown. By way of example, each radially-formed rib pocket PKT may be formed by a combination of an inner wall portion/section of the inner wall IW, a corresponding outer wall portion/section of the outer wall OW, and adjacent radial walls RW1, RW2 connecting the inner wall portion and the corresponding outer wall portion.

The inner wall IW may include, or form part of, an inner circular wall extending around the inner edge of the center bushing, e.g., consistent with that shown in FIGS. 3A and 3B.

The outer wall OW may include, or form part of, an outer circular wall extending around the outer edge of the center bushing, e.g., consistent with that shown in FIGS. 3A and 3B.

By way of example, in FIG. 3 the center bushing CB1 is shown configured with twelve (12) radially-formed rib pockets PKTs. However, the scope of the invention is not intended to be limited to any particular number of radially-formed rib pockets. For example, the scope of the invention is intended to include, and embodiments are envisioned using, a center bushing having more or less than twelve (12) radially-formed rib pockets, e.g., including thirteen (13) radially-formed rib pockets, or fourteen (14) radially-formed rib pockets, etc.; or alternatively eleven (11) radially-formed rib pockets, or ten (10) radially-formed rib pockets, etc.

FIG. 4A: Curved Rib Pockets CRPs

FIG. 4A shows a center bushing CB2 having the pockets configured as curved rib pockets CRP. By way of example, the center bushing surface may include the inner wall, the outer wall and a plurality of curved walls all extending from the center bushing surface. Each curved rib pocket may include a combination of the inner wall portion, the corresponding outer wall portion and adjacent curved walls connecting the inner wall portion and the corresponding outer wall portion.

By way of example, in FIG. 4A the center bushing CB2 is shown configured with twelve (12) curved rib pockets. However, the scope of the invention is not intended to be limited to any particular number of curved rib pockets. For example, the scope of the invention is intended to include, and embodiments are envisioned using, a center bushing having more or less than twelve (12) curved rib pockets, e.g., including thirteen (13) curved rib pockets, or fourteen (14) curved rib pockets, etc.; or alternatively eleven (11) curved rib pockets, or ten (10) curved rib pockets, etc.

FIG. 4B: Extruded Circle or Circular Pockets ECPs

FIG. 4B shows a center bushing CB3 having the pockets configured as extruded pockets in the form of extruded circular pockets ECPs. By way of example, in FIG. 4B the center bushing CB3 is shown configured with thirty six (36) extruded circle or circular pockets, e.g., arranged in a pattern of twelve (12) pairs of extruded circle or circular pockets ECPs, each arranged equi-distant about the center bushing surface and separated by a respective single extruded circle or circular pocket arranged inbetween. However, the scope of the invention is not intended to be limited to any particular number of extruded circle or circular pockets. For example, the scope of the invention is intended to include, and embodiments are envisioned using, a center bushing having more or less than twelve (36) extruded circle or circular pockets, e.g., including thirty seven (37) extruded circle or circular pockets, or thirty eight (38) extruded circle or circular pockets, etc.; or thirty five (35) extruded circle or circular pockets, or thirty four (34) extruded circle or circular pockets, etc.

Moreover, the scope of the invention is not intended to be limited to any particular pattern of extruded circle or circular pockets. For example, the scope of the invention is intended to include, and embodiments are envisioned using, a center bushing having other types or kinds of patterns, e.g., like a pattern of eighteen (18) pairs of extruded circle or circular pockets, each arranged equi-distant about the center bushing surface, or like a pattern of twelve (12) triplets of extruded circle or circular pockets, each arranged equi-distant about the center bushing surface, etc.

By way of example, the extruded pockets ECPs are shown as cylindrical protrusions; however, the scope of the invention is not intended to be limited to any particular geometric shape of the extruded pockets. The scope of the invention is intended to include, and embodiments are envisioned in which, the extruded pockets take the form of other geometric shapes such as extruded 3-sided or triangular pockets, extruded 4-sided or rectangular pockets, extruded 5-sided or pentagonal pockets, etc., as well as other extruded 1-side pockets like oval pockets.

FIG. 4C: Full Length Rib Pockets FLRPs

FIG. 4C shows a center bushing CB4 having the pockets configured as full length rib pockets FLRPs. By way of example, in FIG. 4C the center bushing CB4 is shown configured with six (6) full length rib pockets FLRPs. However, the scope of the invention is not intended to be limited to any particular number of full length rib pockets. For example, the scope of the invention is intended to include, and embodiments are envisioned using, a center bushing having more or less than six (6) full length rib pockets, e.g., including seven (7) full length rib pockets, or eight (8) full length rib pockets, etc.; or alternatively five (5) full length rib pockets, or four (4) full length rib pockets, etc.

The Pin P

The multi-stage pump 10 may include a stationary element, e.g., some part of the pump's casing C, configured with an aperture; and the center bushing CB may include an outer circumferential rim or wall OW (FIG. 2) configured with a pin P to couple into the aperture of the stationary element to prevent rotation of the center bushing CB.

According to some embodiments, the stationary element or part of the pump's casing C may be configured with a circumferential surface having an inner diameter; and the outer circumferential rim may include an outer diameter that substantially corresponds in dimension to the inner diameter of the circumferential surface of the stationary element in order to substantially reduce or prevent leakage between the different stages.

The Pocket Dimensions

The scope of the invention is not intended to be limited by any particular dimensions of the pockets PKT (FIG. 3), CRP (FIG. 4A), ECP (FIG. 4B)or FLRP (FIG. 4C), e.g., including the length, width, diameter, and/or depth of the same, which will depend on the particular application, as would be appreciate by one skilled in the art. By way of example, for one type of multi-stage pump applications the pockets PKT, CRP, ECP or FLRP may be configured with one combination of a given length, width, diameter, and/or depth; while for another type of multi-stage pump applications the pockets PKT, CRP, ECP or FLRP may be configured with another combination of a given length, width, diameter, and/or depth of the same.

Possible Applications

By way of example, in addition to multi-stage pumps other possible applications of the present invention may include, or take the form of, fans, blowers and compressors.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not necessarily drawn to scale.

Although the invention has been described and illustrated with respect to exemplary embodiments thereof, the foregoing and various other additions and omissions may be made therein and thereto without departing from the spirit and scope of the present invention.

What we claim is:

1. A multi-stage pump having a casing, comprising:

a pump having different stages configured to pump a fluid from a pump suction and to a pump discharge, the different stages including a first stage configured with an area of lower pressure, and a second stage configured with a corresponding area of high pressure; and a center bushing coupled to the casing and configured between the first stage and the second stage, having a center bushing side with a high pressure side configured with pockets facing the corresponding area of high pressure to balance axial forces between the first stage and the second stage of the multistage pump.

2. The multi-stage pump according to claim 1, wherein the pockets are configured as radially-formed rib pockets.

3. The multi-stage pump according to claim 2, wherein the center bushing side comprises a center bushing surface having an inner wall, an outer wall and a plurality of radial walls all extending from the center bushing surface, each radially-formed rib pocket having a combination of an inner wall portion, a corresponding outer wall portion and adjacent radial walls connecting the inner wall portion and the corresponding outer wall portion.

4. The multi-stage pump according to claim 3, wherein the inner wall includes, or forms part of, an inner circular wall extending around an inner edge of the center bushing.

5. The multi-stage pump according to claim 4, wherein the outer wall includes, or forms part of, an outer circular wall extending around an outer edge of the center bushing.

6. The multi-stage pump according to claim 3, wherein the outer wall includes, or takes the form of, an outer circular wall extending around an outer edge of the center bushing.

7. The multi-stage pump according to claim 1, wherein the pockets are configured as curved rib pockets.

8. The multi-stage pump according to claim 7, wherein the center bushing side comprises a center bushing surface having an inner wall, an outer wall and a plurality of curved rib walls all extending from the center bushing surface, each curved rib pocket having a combination of an inner wall portion, a corresponding outer wall portion and adjacent curved rib walls connecting the inner wall portion and the corresponding outer wall portion.

9. The multi-stage pump according to claim 8, wherein the inner wall includes, or forms part of, an inner circular wall extending around an inner edge of the center bushing.

10. The multi-stage pump according to claim 1, wherein the pockets are configured as extruded circle or circular pockets.

11. The multi-stage pump according to claim 1, wherein the pockets are configured as full length rib pockets.

12. The multi-stage pump according to claim 11, wherein the center bushing side comprises a center bushing surface having an inner wall, an outer wall and a plurality of rib pocket walls all extending from the center bushing surface, each full length rib pocket having a combination of an inner wall portion, a corresponding outer wall portion and adjacent rib pocket walls connecting the inner wall portion and the corresponding outer wall portion.

13. The multi-stage pump according to claim 1, wherein the multi-stage pump comprises a stationary casing element configured with an aperture formed therein; and the center bushing comprises an outer circumferential rim configured with a pin to couple into the aperture of the stationary casing element to prevent rotation of the center bushing.

14. The multi-stage pump according to claim 13, wherein the stationary element is configured with a circumferential surface having an inner diameter; and the outer circumferential rim has an outer diameter that substantially corresponds in dimension to the inner diameter of the circumferential surface of the stationary element in order to substantially reduce or prevent leakage between the different stages.

15. The multi-stage pump according to claim 13, wherein the first stage is configured to receive the fluid from the pump suction and pump the fluid to the pump discharge; and the second stage is configured to receive the fluid from the pump suction and pump the fluid to the pump discharge.

16. The multi-stage device according to claim 1, wherein the first stage includes an impeller and a wear ring having a wear ring diameter;

the second stage includes a corresponding impeller and a corresponding wear ring having a corresponding wear ring diameter; and the center bushing includes a center bushing diameter that is the same diameter as the wear ring diameter and the corresponding wear ring diameter, so that no diameter difference is introduced that may create another location for axial forces to act upon.

17. A multi-stage device having a stationary casing, comprising:

a device having different stages configured to provide a fluid, the different stages including a first stage configured with an area of lower pressure, and a second stage configured with a corresponding area of high pressure; and a center bushing coupled to the stationary casing to prevent rotation and configured between the first stage and the second stage, having a center bushing side configured with pockets to balance axial forces between the first stage and the second stage of the multistage device.

18. The multi-stage device according to claim 17, wherein the multi-stage device comprises a multi-stage pump, fan, blower or compressor.

19. The multi-stage device according to claim 17, wherein the pockets are configured as radially-formed rib pockets, or curved rib pockets, or extruded circle or circular pockets, or full length rib pockets.

20. A multi-stage pump comprising:

a stationary casing configured with an aperture formed therein;

a pump having a pump suction, a pump discharge, a first stage, and a second inlet stage, the first stage being configured with an area of lower pressure and also configured to receive fluid from the pump suction and pump the fluid to the pump discharge, and the second stage being configured with a corresponding area of high pressure and also configured to receive the fluid from the pump suction and pump the fluid to the pump discharge; and a center bushing coupled to the stationary casing and configured between the first stage and the second stage, and having a center bushing side with a high pressure side configured with pockets facing the corresponding area of high pressure of the second stage to balance axial forces between the first stage and the second stage of the multistage pump, the center bushing having an outer circumferential rim with a pin configured to couple into the aperture of the stationary casing to prevent rotation of the center bushing in relation to the stationary casing.

* * * * *